US005544583A

United States Patent [19]

Banike

[11] Patent Number: 5,544,583

[45] Date of Patent: Aug. 13, 1996

[54] DELIVERY INTERRUPT MECHANISM FOR A PRINTING MACHINE

[75] Inventor: Ronald A. Banike, Orland Park, Ill.

[73] Assignee: A.B. Dick Company, Niles, Ill.

[21] Appl. No.: 488,739

[22] Filed: Jun. 8, 1995

[51] Int. Cl.[6] ..... B41F 13/64

[52] U.S. Cl. ..... 101/240; 270/58.17; 270/58.01; 271/189; 271/221; 271/217; 414/789; 414/789.1

[58] Field of Search ..... 101/232, 240, 101/241, 242; 270/53, 58; 271/184, 189, 207, 213, 214, 219, 216, 217, 218, 221; 414/789, 789.1, 788.9

[56] References Cited

U.S. PATENT DOCUMENTS

| | | | |
|---|---|---|---|
| 4,928,941 | 5/1990 | Uto et al. . | |
| 5,005,822 | 4/1991 | Max et al. | 414/789 |
| 5,103,733 | 4/1992 | Drapatsky et al. . | |
| 5,125,639 | 6/1992 | Henn | 414/789.1 |
| 5,259,309 | 11/1993 | Stiel | 101/232 |
| 5,374,051 | 12/1994 | Ulrich | 271/221 |
| 5,377,588 | 1/1995 | Fricke | 101/240 |
| 5,393,042 | 2/1995 | Coombs et al. . | |
| 5,397,120 | 3/1995 | Schulz et al. | 271/214 |
| 5,433,429 | 7/1995 | Muller | 271/189 |

OTHER PUBLICATIONS

Drawing of "Interrupter Employed in Ryobi Model 3985 Offset Press" w/attached sheet of reference numerals.

*Primary Examiner*—Eugene H. Eickholt
*Attorney, Agent, or Firm*—Leydig, Voit & Mayer

[57] ABSTRACT

A delivery interrupt mechanism for a printing machine includes a support frame having a stationary guide defining a guide path. A flexible finger is slidably supported by the guide for movement along a curved portion of the guide path while substantially conforming in shape to the curved portion between a retracted position and an extended position in which the finger extends from the frame to support leading edges of printed sheets in a printing machine. The finger is connected to a rotatable input shaft mounted on the frame so that the finger is moved along the curved portion of the guide path between its retracted and extended positions when the input shaft is rotated.

17 Claims, 6 Drawing Sheets

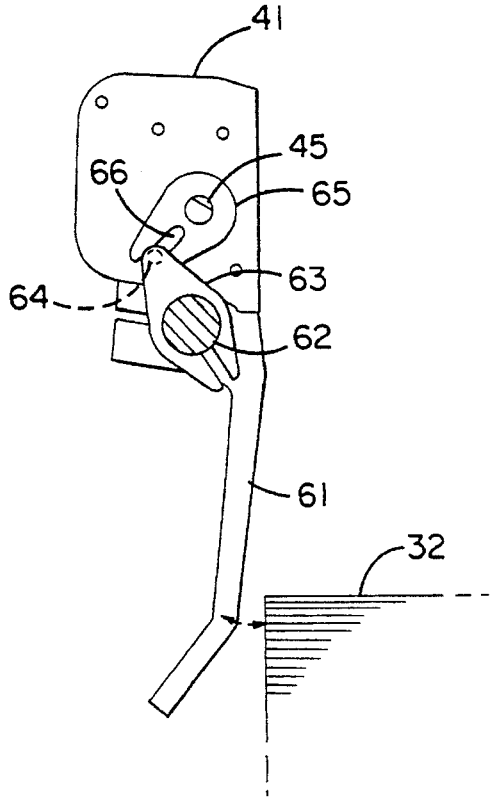
FIG. 9
FIG. 10
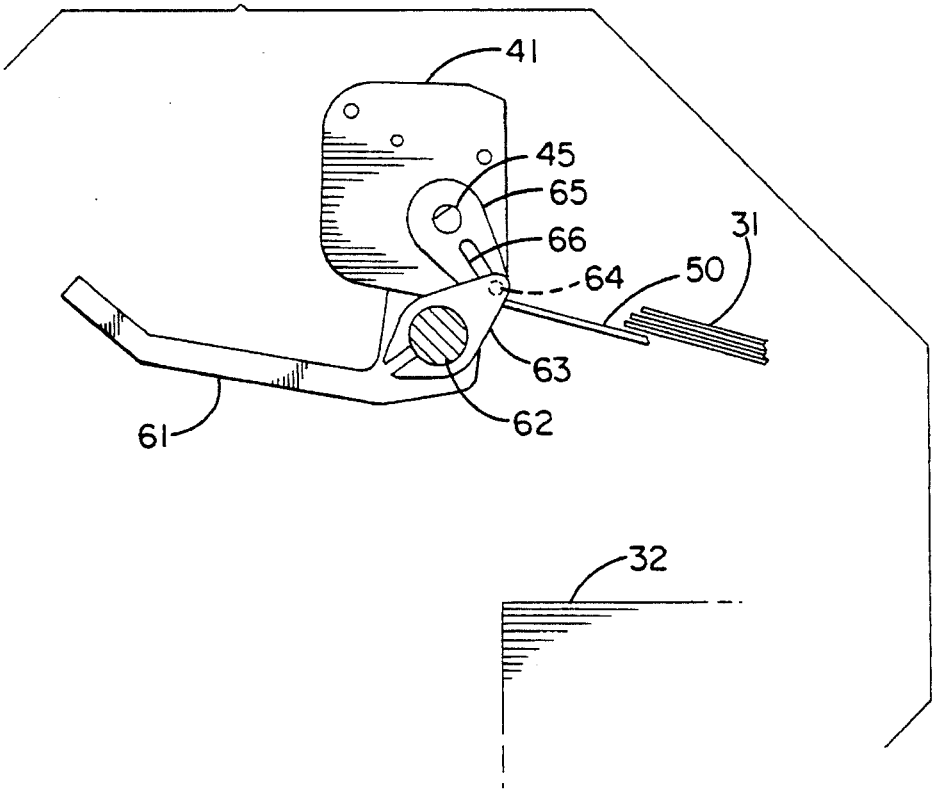

DELIVERY INTERRUPT MECHANISM FOR A PRINTING MACHINE

BACKGROUND OF THE INVENTION

1. Field of the Invention

This invention relates to a delivery interrupt mechanism for use in a printing machine.

2. Description of the Related Art

It is frequently desirable to be able to inspect the printed output of a printing machine as printing is being carried out. In a typical printing machine, individual sheets of paper sequentially pass through a printing section of the printing machine where they undergo printing and are then forwarded to an output section of the printing machine where the printed sheets are sequentially placed atop one another in a vertical output stack. If the printing machine is operating at a high speed, such as at the rate of several impressions per second, there is insufficient time for the operator of the printing machine to manually remove a printed sheet off the top of the output stack to inspect the sheet before subsequent sheets have settled atop the sheet which the operator is trying to remove. This can result in the sheets at the top of the output stack becoming misaligned and disturbing the neatness of the output stack. Therefore, some printing machines are equipped with a device, commonly referred to as a delivery interrupt mechanism, to temporarily prevent printed sheets from settling on the output stack and thereby give the operator of the printing machine time to remove a sheet from the top of the output stack.

A delivery interrupt mechanism generally includes a rigid finger movable between a retracted and an extended position. In the extended position, the finger projects into a path of movement of the printed sheets and supports the leading edge of the printed sheets to prevent their settling onto the output stack. When the finger is extended, the operator of the printing machine can easily remove a printed sheet from the top of the output stack by hand and inspect the sheet. After the sheet being inspected has been removed from the output stack, the finger of the delivery interrupt mechanism is moved to its retracted position where it is clear of the path of movement of the printed sheets, and the printed sheets which were temporarily supported by the finger are allowed to settle onto the output stack.

However, existing delivery interrupt mechanisms tend to be large and have limited actuating options, so they are difficult to apply to small printing machines having limited interior space.

SUMMARY OF THE INVENTION

Accordingly, it is an object of the present invention to provide a delivery interrupt mechanism for a printing machine which is compact and inexpensive to manufacture and has a multiplicity of actuating options.

It is another object of the present invention to provide a printing machine equipped with such a delivery interrupt mechanism.

A delivery interrupt mechanism for a printing machine according to the present invention includes a support frame having a stationary guide defining a guide path. A finger which is flexible for at least a portion of its length is slidably supported by the guide for movement along a curved portion of the guide path while substantially conforming in shape to the curved portion between a retracted position and an extended position in which the finger extends from the frame to support leading edges of printed sheets in a printing machine. The finger is connected to a rotatable input shaft mounted on the frame so that the finger is moved along the curved portion of the guide path between its retracted and extended positions when the input shaft is rotated.

A printing machine according to the present invention includes a printing section, an output section adjoining the printing section for stacking printed sheets from the printing section in an output stack, and a delivery interrupt mechanism disposed in the output section adjoining the output stack. The delivery interrupt mechanism comprises a frame and a finger flexible along at least a portion of its length and supported by the frame for movement between an extended position in which the finger extends from the frame into a path of movement of printed sheets onto the output stack to support leading edges of the sheets and a retracted position in which the finger is withdrawn from the path of movement of the printed sheets and is supported on the frame with a portion of the finger in a coiled state.

A delivery interrupt mechanism according to the present invention is not restricted to use with a particular type of printing machine. For example, it can be employed with an offset press, a xerographic printing press, or any other type of printing machine in which printed sheets are arranged in an output stack in an output section of the printing machine.

BRIEF DESCRIPTION OF THE DRAWINGS

FIG. 9 is a side elevation of the exterior of the delivery interrupt mechanism as installed in the printing machine with the finger in a retracted position.

FIG. 10 is a side elevation of the exterior of the delivery interrupt mechanism with the finger in an extended position.

DESCRIPTION OF PREFERRED EMBODIMENTS

Figure 1:
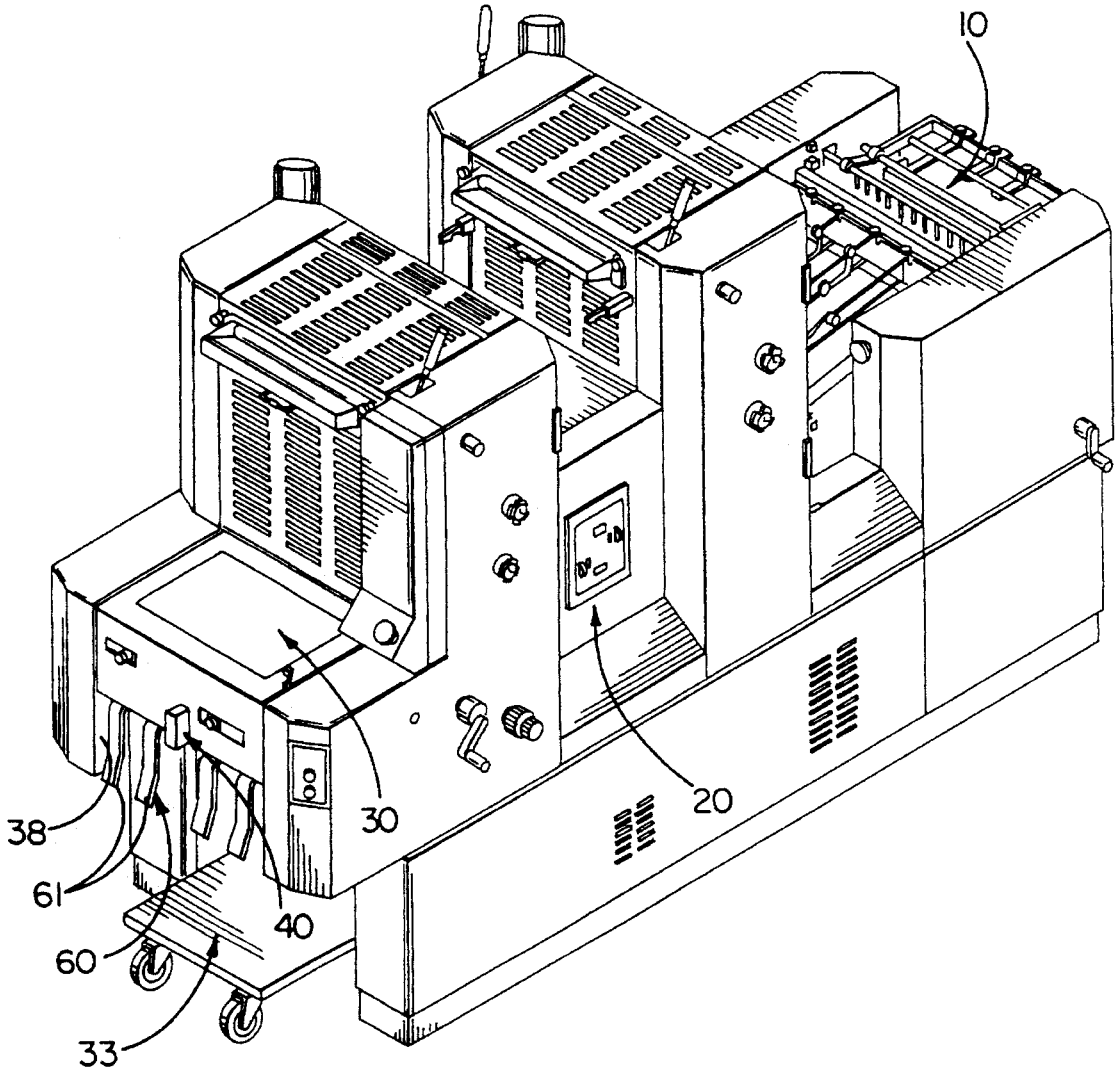
FIG. 1 is a perspective view of a printing machine equipped with an interrupt delivery mechanism according to the present invention.

FIG. 1 illustrates a printing machine employing an embodiment of a delivery interrupt mechanism according to the present invention. The illustrated printing machine is an offset printing press and includes a paper feed section 10, a printing section 20, and an output section 30. The paper feed section 10 supplies individual sheets of paper to the printing section 20 from an unillustrated input stack. After the printing section 20 carries out printing of the sheets, the printed sheets are supplied to the output section 30, which forms the printed sheets into an output stack atop a receiving dolly 33. The structure of the paper feed section 10, the printing section 20, and the output section 30 is not critical to the operation of the present invention, and the printing machine can be any of a wide variety of commercially available models, such as the ABDICK Century 3000 offset printing press.

Figure 2:
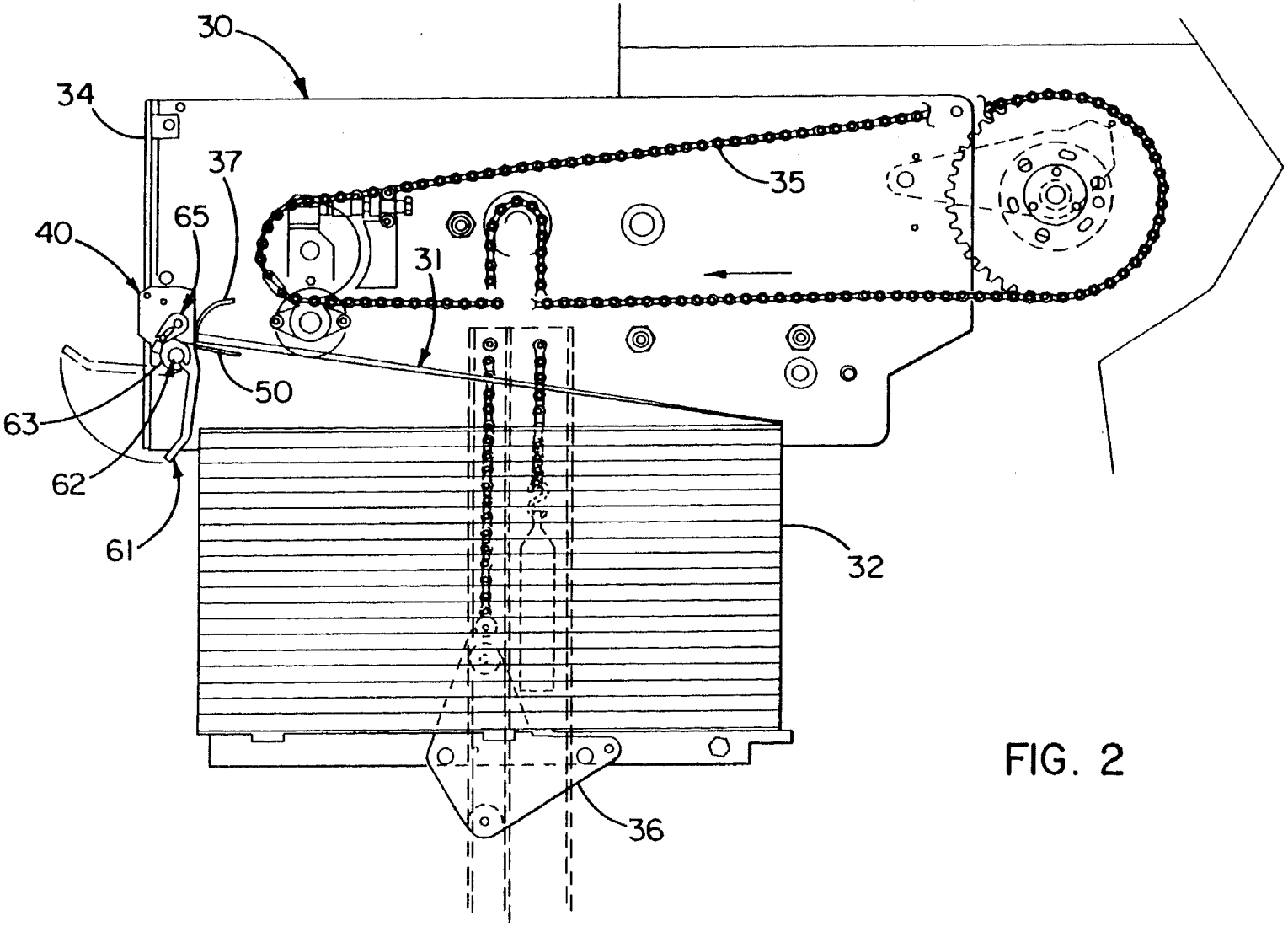
FIG. 2 is a side elevation of the interior of the output section of the printing machine of FIG. 1.

FIG. 2 is a side elevation of the interior of the output section 30. The output section 30 includes a delivery chain 35 which circulates in the direction of the arrow in the figure. The delivery chain 35 is equipped with unillustrated grippers which carry printed sheets 31 one by one from the printing section 20 to atop the output stack 32, the upper surface of which is usually horizontal. As is conventional, the output stack 32 is supported by an elevator mechanism 36 which gradually lowers the output stack 32 as the number of sheets in the output stack 32 increases so as to maintain the upper surface of the output stack 32 at a substantially constant height.

A curved paper guide 37 is disposed near the left end of the delivery chain 35 above the output stack 32. When a printed sheet 31 carried by the delivery chain 35 is released by the grippers on the delivery chain 35, the sheet 31 continues to move forward until its leading edge strikes the paper guide 37, which stops the forward motion of the sheet 31, and the sheet 31 settles downward to atop the output stack 32.

A delivery interrupt mechanism 40 according to the present invention is supported by the housing 34 of the output section 30 in the vicinity of the output stack 32, such as adjoining the paper guide 37. The delivery interrupt mechanism 40 includes a flexible finger 50 movable between a retracted position and an extended position. When the finger 50 is in the extended position, shown in FIG. 2, it projects below the paper guide 37 into a path of movement of the printed sheets 31 onto the output stack 32. In this position, it supports the leading edges of printed sheets 31, which have struck the paper guide 37, in a position above the output stack 32 and prevents the leading edges of the printed sheets 31 from settling onto the output stack 32, although the trailing edges may do so. With the .leading edges of the printed sheets 31 supported by the finger 50 above the output stack 32, the operator of the printing machine can remove a printed sheet 31 from atop the output stack 32 and inspect it without disturbing the neatness of the output stack 32. When the finger 50 is in its retracted position, it is withdrawn from the path of movement of the printed sheets 31, which can neatly settle to a flat position atop the output stack 32.

FIGS. 3 and 5–8 illustrate the delivery interrupt mechanism 40 in greater detail. As shown in these figures, it includes a support frame in the form of a housing 41 which supports the finger 50 for movement along a curved path within the housing 41. The housing 41 has first and second sections 41*a* and 41*b* which are joined to each other in any desired manner such as by screws or a snap fit. An input shaft 45 is supported for rotation about its axis by cylindrical bearings 46 mounted on the housing 41. Stationary guides in the form of slots 42 are formed in the opposing inner surfaces of the housing sections 41*a* and 41*b* for slidably guiding the finger 50 along the curved path. The radially outer peripheries of the slots 42 are defined by the outer wall of the housing, while the inner peripheries are defined by walls 43 which project towards each other from opposing inner surfaces of the housing sections 41*a* and 41*b*. The slots 42 terminate in a first outlet 44 through which the finger 50 projects when extended. The slots 42 are curved along at least a portion of their length so that at least a portion of the finger 50 may be formed into a compact, coiled shape conforming to the shape of the slots 42 when the finger 50 is retracted into the housing 41. The curved portions of the slots 42 may extend for all or less than the lengths of the slots 42. For example, in FIGS. 7 and 8, each slot 42 has a linear portion 42*a* adjoining the first outlet 44 and a curved portion 42*b* which blends smoothly into the end of the linear portion 42*a*. The curved portion 42*b* is not restricted to a particular shape. In the present embodiment, the curved portion 42*b* comprises an arc of a circle, the arc spanning at least 90 degrees as measured from the axis of the input shaft 45. The slope of the slots 42 with respect to the vertical adjoining the first outlet 44 determines the direction in which the finger 50 extends from the housing 41 in its extended position. The finger 50 may extend in any direction which permits it to support the leading edges of the printed sheets 31 above the output stack 32. Preferably, the finger 50 extends nonhorizontally, such as at an angle at which an imaginary plane coinciding with the extended portion of the finger 50 intersects the top surface of the output stack 32. If the finger 50 is so oriented, the leading edges of printed sheets 31 supported by the finger 50 can lie substantially flat against the finger 50, and creasing of the leading edges of the sheets 31 due to contact with the finger 50 can be minimized. In this embodiment, the imaginary plane intersects the top surface of the output stack 32 at approximately the trailing edge of the output stack 32. A vertical plane coinciding with the longitudinal centerline of the finger 50 is preferably substantially parallel to the longitudinal centerline of the output stack 32.

The illustrated housing 41 is shaped so as to substantially surround the finger 50 in its retracted position. However, as long as the housing 41 can support the finger 50 for movement between its retracted and extended positions, the shape of the housing 41 is not important, and it may have substantial open portions. In addition, a portion of the finger 50 may extend to the outside of the housing 41 when the finger 50 is in its retracted position, as long as this portion does not interfere with the movement of the printed sheets 31 onto the output stack 32.

The portion of the finger 50 which extends outside of the housing 41 when the finger 50 is in its extended position is preferably substantially straight, but it need not be straight as long as it can stably support a plurality of printed sheets 31 above the output stack 32. In the present embodiment, the entire finger 50 is substantially straight when in a relaxed state.

The finger 50 may be guided along the curved path within the housing 41 by guide members other than slots 42, such as by rollers or pins around which the finger 50 passes. The housing sections 41*a* and 41*b* in this embodiment are substantially mirror images of each other, and slots 42 are formed in both sections. Alternatively, a guide slot 42 may be formed in a single one of the sections of the housing 41 instead of in both, and the other section may serve as a cover for the section containing the slot 42.

Figure 6:
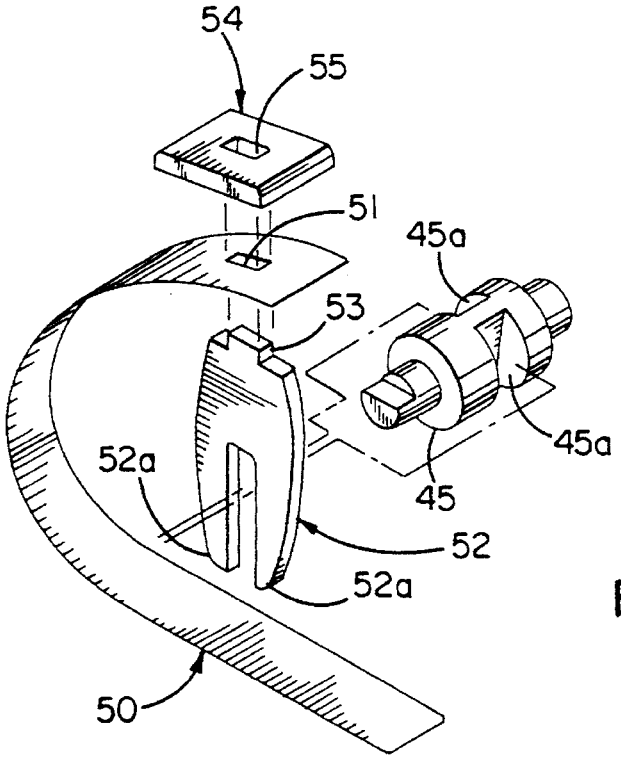
FIG. 6 is an exploded view of the moving portions within the housing of the delivery interrupt mechanism.
Figure 7:
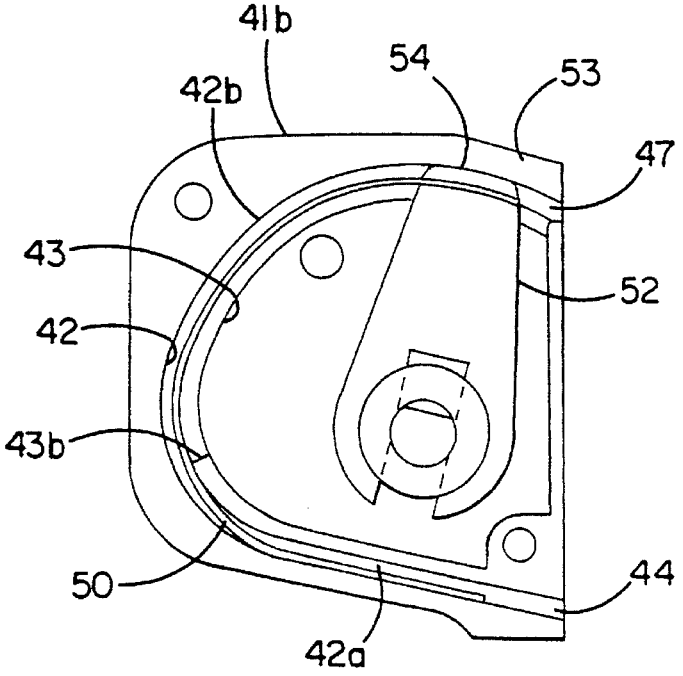
FIG. 7 is a side elevation of the interior of the delivery interrupt mechanism, showing the finger in a retracted position.
Figure 8:
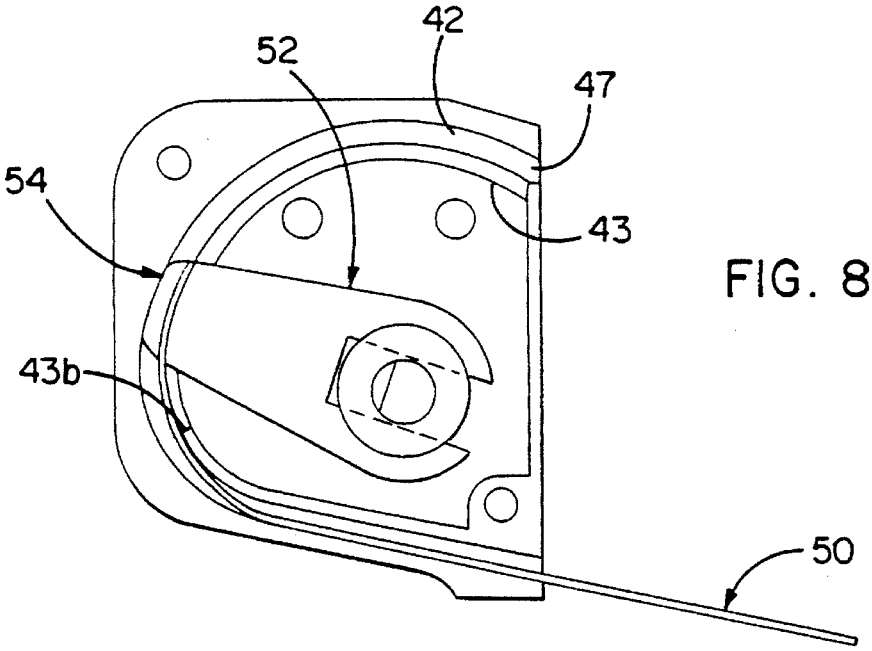
FIG. 8 is a side elevation of the interior of the delivery interrupt mechanism, showing the finger in an extended position.

The input shaft 45 is drivingly coupled to the finger 50 by a connecting member in the form of a rotating arm 52 having a radial inner end secured to the input shaft 45 and an outer end connected to the finger 50 in any manner which permits the arm 52 to transmit an axial drive force to the finger 50 when the input shaft 45 is rotated. As shown in FIG. 6, in this embodiment, a slot is formed on the radially inner end of the arm 52 to divide the radially inner end into a pair of legs 52*a* which engage with slots 45*a* formed in the outer surface of the input shaft 45. A projection 53 is formed on the radial outer end of the arm 52 for engagement with a slot or hole 51 formed in the end of the finger 50. The hole 51 in the finger 50 is sized to fit loosely on the projection 53 of the arm 52, and the finger 50 is held in place on the arm 52 by a polymeric retainer 54 made of nylon, for example, having a hole 55 which is press fit onto the projection 53 atop the end of the finger 50. If the finger 50 has more than one hole 51, the length by which the finger 50 projects from the housing 41 can be adjusted by changing the hole 51 into which the projection 53 is inserted. In this embodiment, there is no relative movement between the radially outer end of the arm 52 and the portion of the finger 50 with which it engages as the arm 52 rotates. However, if the curved portions **42*b* of the slots 42 have a nonconstant radius, the finger 50 may be connected to the arm 52 so as to be able to slide in the radial direction of the arm 52 as the arm 52 rotates. The arm 52 rotates by approximately 90 degrees in FIGS. 7 and 8 between the retracted and extended positions of the finger 50, but the angle of rotation may vary, depending upon the length of the arm 52 and the length by which the finger 50 extends from the housing 41 in its extended position. A gap 43*a* is formed between the opposing surfaces of the walls 43 over a portion of their length so that the arm 52 can pass between the walls 43 as the arm 52 rotates. A stopping surface 43*b* for limiting the rotation of the arm 52 is defined on the walls 43 where the gap 43*a* ends and the opposing surfaces of the walls 43** come into contact.

A second outlet 47 may be formed in the housing 41 at the end of the slots 42 remote from the first outlet 44 in order to prevent the end of the finger 50 attached to the arm 52 from striking against the interior of the housing 41.

Figure 5:
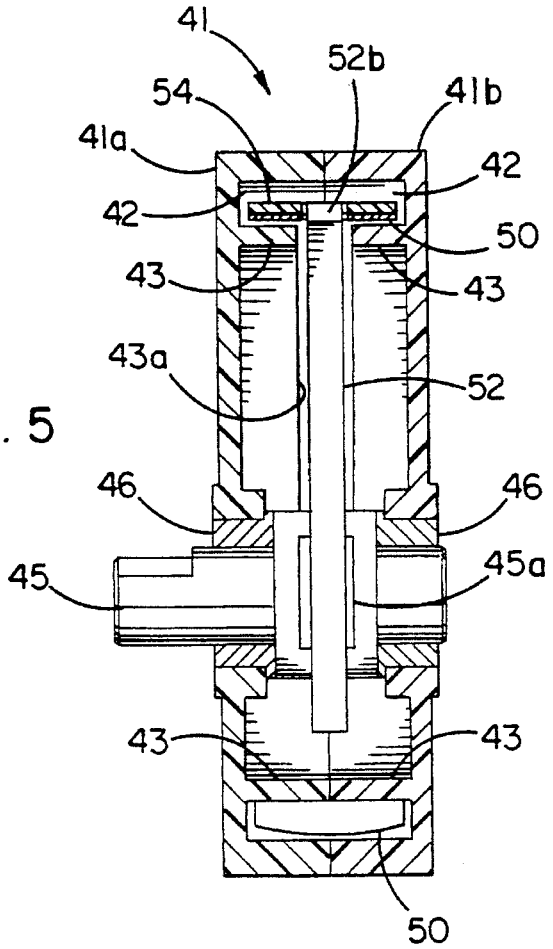
FIG. 5 is a vertical cross section of the delivery interrupt mechanism.

The finger 50 may have any cross-sectional shape that enables it to readily bend within the slots 52. In this embodiment, the finger 50 is in the form of a thin strip having a constant width and a constant thickness smaller than the width. A finger 50 in the form of a strip may have a completely flat transverse cross-sectional shape, or the cross section may be slightly cambered in a relaxed state, as shown in FIG. 5, to give the extended portion of the finger 50 increased bending strength. Examples of other possible transverse cross-sectional shapes of the finger 50 are rod-shaped, tubular, and channel-shaped.

The finger 50 can be made of any material which is flexible enough along at least a portion of its length to conform to the shape of the curved portions **42*b* of the slots 42 but rigid enough so that the portion which extends from the housing 41 when the finger 50 is extended can support the leading edges of a plurality of printed sheets 31. Examples of suitable materials for the finger 50 are metals such as spring steel, plastics, rubber, and other polymeric materials. Metals are particularly suitable because they have less tendency to take on a permanent set than do polymers when coiled inside the housing 41**, i.e., they can undergo completely elastic deformation when retracted and extended.

In this embodiment, for simplicity of design and ease of manufacture, the finger 50 has a uniform stiffness and cross-sectional area over substantially its entire length, except for the portion containing the hole 51, but the characteristics of the finger 50 may vary along its length. For example, instead of having a constant width over its length, the width of the finger 50 may be tapered towards the outer end. Furthermore, the inner portion of the finger 50 which always remains within the housing 41 functions mainly to transmit axial forces to the outer portion of the finger 50 (the portion which is extended outside the housing 41) and is not required to resist substantial bending moments, so it may be significantly more flexible than the outer portion of the finger 50, which supports the weight of printed sheets 31. Thus, instead of the inner portion and the outer portion of the finger 50 being integral with each other, the inner portion of the finger 50 could have a different structure from the outer portion and be coupled to the outer portion so as to transmit axial forces to the outer portion. For example, the inner portion of the finger 50 could be a chain while the outer portion is a strip. Conversely, if the only portion of the finger 50 to ever extend outside the housing 41 is received entirely in the linear portions **42*a* of the slots 42, it is not necessary for this portion of the finger 50** to be flexible.

A drive force applied to the input shaft 45 can be transmitted to the finger 50 by a connecting member other than a rotating arm 52. For example, the arm 52 may be replaced by a wheel secured to the input shaft 45 and having a projection along its circumference which engages with the hole 51 in the finger 50, by a roller secured to the input shaft 45 and frictionally engaging the finger 50, or by a spool around which the finger 50 is wrapped.

In order to increase the length of the finger 50 which can be disposed in the housing 41 without increasing the size of the housing 41, the finger 50 in its retracted position may be coiled around itself.

The maximum amount by which the finger 50 extends from the housing 41 in its extended position will depend upon a number of factors, such as the weight and stiffness of the sheets 31 which the finger 50 is intended to support. The greater the amount of extension, the greater should be the stiffness of the finger 50 to prevent it from sagging under the weight of the sheets 31. As an example, for a finger 50 made of fully-tempered spring steel with a width of approximately ½ inch and a thickness of approximately 0.005 inches, an extension from the housing 41 of approximately 2 inches has been found suitable. The height of the extended portion of the finger 50 above the output stack 32 is preferably great enough for an operator to easily insert his fingers between the finger 50 and the top of the output stack 32 to grasp a sheet 31 off the output stack 32.

In the illustrated embodiment, the slots 42 curve upward from the first outlet 44 of the housing 41, but the slots 42 may instead curve downwards. However, if the finger 50 has a cambered cross section, it is preferable if the concave side of the finger 50 faces upwards, in which case the slots 42 will generally curve upward from the first outlet 44. In most instances, it is preferable for the broadest surface of the finger 50, i.e., the top or bottom surface to support the printed sheets 31, so the housing 41 is oriented such that the input shaft 45 rotates about a horizontal axis. However, for small printed items, such as index cards, the narrow edge of the finger 50 may be broad enough to support the items, in which case the housing 41 may be mounted so that the input shaft 45 rotates about a nonhorizontal axis, such as a vertical axis.

Figure 4:
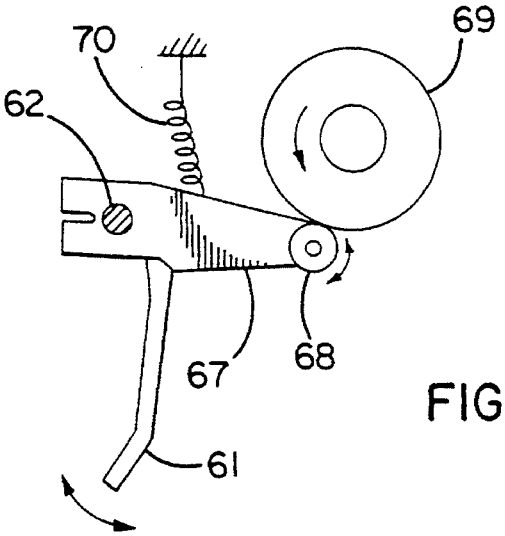
FIG. 4 is a schematic side elevation of a drive portion of the jogger mechanism.

When it is desired to retract or extend the finger 50, the operator of the printing machine causes the input shaft 45 to rotate. The input shaft 45 can be rotated by any type of device, such as an electric motor or a manually operated lever drivingly connected to the input shaft 45. In the present embodiment, the input shaft 45 is linked to a conventional jogger mechanism 60 installed in the output section 30 of the printing machine and is rotated by manipulation of the jogger mechanism 60. The jogger mechanism 60 includes a plurality of finger-like joggers 61 secured to a jogger shaft 62 rotatably supported by the housing 34 of the output section 30 in an access opening 38. The joggers 61 can be manually pivoted together with the jogger shaft 62 between a lowered position, shown by solid lines in FIG. 2, in which the joggers 61 are substantially vertical and define a gate across the access opening 38, and a raised position, shown by dashed lines in FIG. 2, in which the joggers 61 extend substantially horizontally so that an operator can insert his hand through the access opening 38 and access the output stack 32. When the joggers 61 are in the lowered position, a slight oscillatory motion is imparted to the jogger shaft 62 by a known drive mechanism, an example of which is shown in FIG. 4, to cause the joggers 61 to pivot back and forth and tamp the leading edge of the output stack 32 in order to keep the sheets 31 of paper aligned in the lengthwise direction of the stack 32. In the drive mechanism of FIG. 4, an arm 67 having a roller 68 mounted at one end is secured to the jogger shaft 62. When the joggers 61 are in their lowered position, the roller 68 is urged into contact with a rotating cam 69 by a biasing spring 70 connected between the arm 67 and the housing 34 of the output section 30. The 69 cam has an axis of rotation which is eccentric with respect to the periphery of the cam 69. As the cam 69 is rotated about its axis by an unillustrated motor or other drive member, the contact between the outer surface of the cam 69 and the roller 68 causes the arm 67 and the jogger shaft 62 to slightly oscillate about the axis of the jogger shaft 62. Since the joggers 61 are secured to the jogger shaft 62, the joggers 61 oscillate along with the arm 67 and the jogger shaft 62. The amount of oscillation of the joggers 61 in their lowered position will depend upon the printing machine, but is commonly on the order of 4 degrees about the axis of the jogger shaft 62. When the joggers 61 are manually pivoted to their raised position, the roller 68 is moved out of contact with the cam 69, so in this position the joggers 61 do not oscillate.

Figure 3:
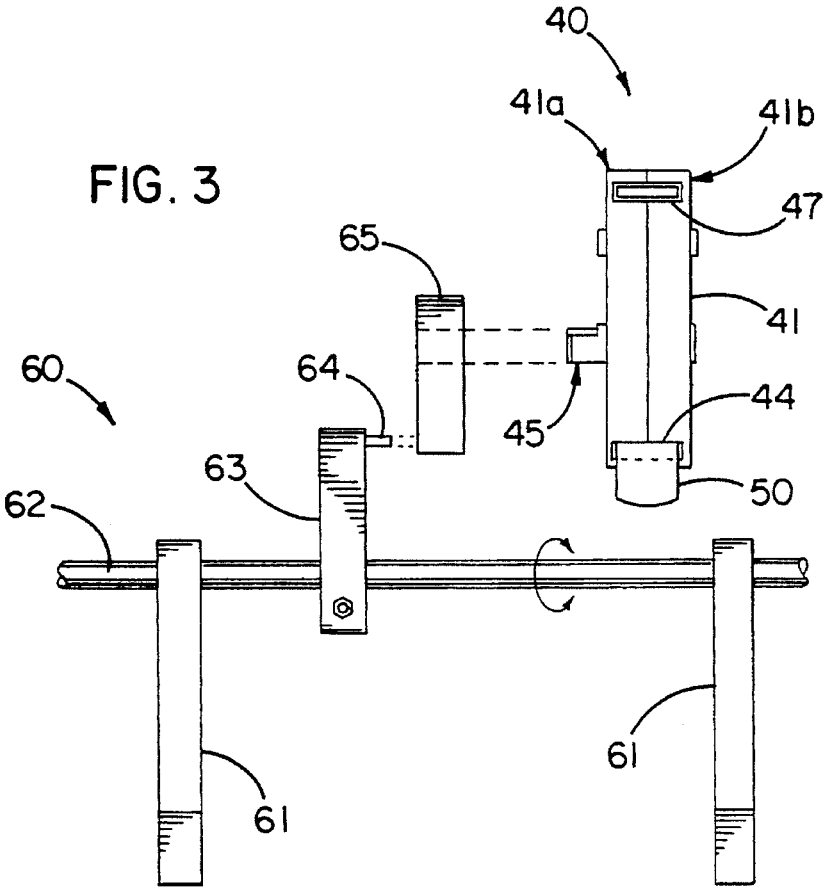
FIG. 3 is an exploded front elevation of a portion of the jogger mechanism and delivery interrupt mechanism of FIG. 1.

The jogger shaft 62 is coupled to the input shaft 45 of the delivery interrupt mechanism 40 so that rotation of the jogger shaft 62 as the joggers 61 are manually moved between their raised and lowered positions can produce rotation of the input shaft 45. As shown in FIGS. 3, 9, and 10, the jogger shaft 62 and the input shaft 45 are coupled by a first link 63 secured to the jogger shaft 62 and a second link 65 secured to the input shaft 45 and engaging the first link 63. A pin 64 formed on the first link 63 slidingly engages an elongated slot 66 formed in the second link 65. When the joggers 61 are manually pivoted clockwise from their lowered position (shown in FIG. 9) to their raised position (shown in FIG. 10), the first link 63 likewise pivots clockwise, and the engagement between the links 63 and 65 causes the second link 65 and the input shaft 45 to pivot in the counterclockwise direction about the axis of the input shaft 45, thereby moving the finger 50 from its retracted position to its extended position. Conversely, when the joggers 61 are manually pivoted counterclockwise from the raised position to the lowered position, the second link 65 and the input shaft 45 are made to pivot clockwise about the axis of the input shaft 45, thereby moving the finger 50 from its extended position back to its retracted position. Preferably, the engagement between the pin 64 and the slot 66 provides a degree of lost motion between the two links 63 and 65 when the joggers 61 are in their lowered position so that when the joggers 61 are oscillating back and forth about the axis of the jogger shaft 62, the lost motion prevents the oscillation from being transmitted to the second link 65 and the input shaft 45. For example, if the joggers 61 normally oscillate by approximately 4 degrees, providing this amount of lost motion will prevent the input shaft 45 from oscillating with the joggers 61. However, if a small amount of motion of the finger 50 in its retracted position will not cause the finger 50 to block the path of movement of the printed sheets 31 onto the output stack 32, the jogger shaft 62 and the input shaft 45 may be linked by a connection with little or no lost motion.

In some printing machines, the output section is equipped with a gate pivotable about a horizontal axis and disposed in the access opening 38 in place of the pivotable joggers 61 in the printing machine of FIG. 1. In such a printing machine, the gate can be coupled to the delivery interrupt mechanism 40 so as to rotate the input shaft 45 as the gate is swung between an open and a closed position, in much the same manner as the jogger shaft 62 is connected to the input shaft 45 in the illustrated embodiment.

For some types of printed sheets, the delivery interrupt mechanism 40 may be unnecessary or unsuitable, so the delivery interrupt mechanism 40 is preferably coupled to the jogger shaft 62 so that the delivery interrupt mechanism 40 can be disabled when desired without affecting the operation of the jogger mechanism 60. In the present embodiment, the first link 63 is secured to the jogger shaft 62 by means of an unillustrated set screw. When the set screw is loosened, the first link 63 can be moved in the axial direction of the jogger shaft 62 to disengage the pin 64 from the slot 66, thereby preventing the rotation of the jogger shaft 62 from being transmitted to the input shaft 45. As a result, the joggers 61 can be raised without actuating the delivery interrupt mechanism 40.

The output section 30 may be equipped with a single delivery interrupt mechanism 40, as in the illustrated embodiment, or a plurality of the mechanisms 40 may be spaced from each other in the widthwise direction of the output section 30, depending upon the width and stiffness of the printed sheets 31 to be supported. If only a single delivery interrupt mechanism 40 is employed, it is preferably situated near the widthwise center of the output stack 32 so as to stably support the printed sheets 31. However, if the finger 50 is sufficiently wide, it may instead be disposed off-center with respect to the output stack 32.

A delivery interrupt mechanism according to the present invention includes only a small number of components, so it is economical to manufacture and easy to assemble. Because the finger 50 is curved in its retracted position, the delivery interrupt mechanism can be extremely compact, making it easier to install in a desired location of the output section of the printing machine. In particular, due to its compactness, it can be readily installed on existing printing machines not specifically designed for use with a delivery interrupt mechanism.

What is claimed is:

1. A delivery interrupt mechanism for a printing machine comprising:

a support frame having a stationary guide defining a guide path having a curved portion;

an input shaft rotatably supported by the frame;

a flexible finger slidably supported by the guide for movement along the curved portion of the guide path while substantially conforming in shape to the curved portion between a retracted position and an extended position in which the finger extends from the frame to support leading edges of printed sheets in a printing machine; and a connecting member connected between the input shaft and the finger for rotation with the input shaft, the connecting member moving the finger along the curved portion of the guide path between its retracted and extended positions when the input shaft is rotated.

2. A mechanism according to claim 1 wherein the connecting member comprises an arm secured to the input shaft.

3. A mechanism according to claim 1 wherein the frame comprises a housing containing the guide and having an outlet from which the finger extends in its extended position.

4. A mechanism according to claim 3 wherein the finger can be entirely retracted into the housing.

5. A mechanism according to claim 3 wherein the guide path has a linear portion adjoining the outlet.

6. A mechanism according to claim 1 wherein the finger comprises a strip flexible along at least a portion of its length.

7. A mechanism according to claim 6 wherein the finger comprises a metal strip.

8. A mechanism according to claim 6 wherein the finger has a cambered transverse cross section in an undeformed state.

9. A mechanism according to claim 6 wherein the finger has a substantially uniform transverse cross-sectional shape in an undeformed state over substantially its entire length.

10. A mechanism according to claim 1 wherein the guide comprises a slot formed in the housing.

11. A printing machine comprising:

a printing section for producing printed sheets;

an output section adjoining the printing section for stacking printed sheets from the printing section in an output stack; and a delivery interrupt mechanism disposed in the output section adjoining the output stack and comprising a frame and a flexible finger supported by the frame for movement between an extended position in which the finger extends from the frame into a path of movement of the printed sheets onto the output stack to support leading edges of the printed sheets in a position raised above the output stack and a retracted position in which the finger is withdrawn from the path of movement of the printed sheets and is supported on the frame with a portion of the finger in a coiled state.

12. A printing machine according to claim 11 wherein the delivery interrupt mechanism includes an input shaft rotatably supported by the frame and operatively connected to the finger to move the finger between its retracted and extended position when the input shaft is rotated about its axis.

13. A printing machine according to claim 11 wherein the support frame includes a stationary guide defining a guide path having a curved portion, the finger being slidably supported by the guide for movement along the curved portion of the guide path between the retracted position and the extended position while substantially conforming in shape to the curved portion, the delivery interrupt mechanism further comprising:

an input shaft rotatably supported by the frame; and a connecting member connected between the input shaft and the finger for rotation with the input shaft, the connecting member moving the finger along the curved portion of the guide path between its retracted and extended positions when the input shaft is rotated about its axis.

14. A printing machine according to claim 12 wherein the output section includes a jogger mechanism having a jogger movable between a first position in which the jogger can tamp a leading edge of the output stack and a second position permitting access to the output stack, the jogger being operatively connected to the input shaft of the delivery interrupt mechanism so that the finger moves from its retracted position to its extended position when the jogger is moved from its first position to its second position.

15. A printing machine according to claim 14 wherein:

the jogger mechanism imparts an oscillatory motion to the jogger when the jogger is in its first position; and the jogger is connected to the input shaft of the delivery interrupt mechanism in a manner preventing the oscillatory motion of the jogger from being transmitted to the input shaft when the jogger is in its first position.

16. A printing machine according to claim 11 wherein the finger in its extended position extends substantially parallel to a vertical plane coinciding with a longitudinal centerline of the output stack.

17. A printing machine according to claim 16 wherein the finger in its extended position extends substantially towards a trailing edge of the top of the output stack.

* * * * *